United States Patent [19]

Johansson

[11] Patent Number: 4,932,090

[45] Date of Patent: Jun. 12, 1990

[54] MOVABLE SUPPORT BAR

[76] Inventor: Paul J. Johansson, 1416 Grant Rd., Northbrook, Ill. 60062

[21] Appl. No.: 336,732

[22] Filed: Apr. 12, 1989

[51] Int. Cl.[5] ..... A61G 7/06

[52] U.S. Cl. ..... 5/445; 5/503; 5/508

[58] Field of Search ..... 5/84, 87, 445, 503, 5/507, 508; 248/283, 296, 297.3; 4/560–562

[56] References Cited

U.S. PATENT DOCUMENTS

| | | | |
|---|---|---|---|
| 1,840,170 | 1/1932 | Neils | 5/445 |
| 3,862,282 | 2/1975 | Stillwell | 5/503 |
| 4,253,207 | 3/1981 | Marcyan | 5/84 |
| 4,847,930 | 7/1989 | Späth | 5/495 X |

FOREIGN PATENT DOCUMENTS

| | | | |
|---|---|---|---|
| 3327320 | 7/1983 | Fed. Rep. of Germany | 5/84 |
| 2500743 | 9/1982 | France | 5/445 |
| 82/02832 | 9/1982 | PCT Int'l Appl. | 5/60 |

*Primary Examiner*—Michael F. Trettel
*Attorney, Agent, or Firm*—Leydig, Voit & Mayer

[57] ABSTRACT

An improved movable support bar which is mounted by an upstanding support tube to aid disabled or invalid persons. The movable support bar includes a pivotal support arm mounted into the support tube which is securely retained in the support tube and can be adjusted in height relative to the support tube. The pivotal support arm can be rotated freely between positions by lifting the pivotal support arm or can include a trigger release.

The pivotal support arm is retained in the support tube by a bushing mounted in the support tube and retaining pins extending through the pivotal support arm above and below the bushing. The upper pin is secured in slots in the bushing surface to fix the positions of the pivotal support arm. The support tube can be mounted onto a floor surface by a base support member or onto a bed frame by a flange.

26 Claims, 2 Drawing Sheets

FIG. 1 (PRIOR ART)
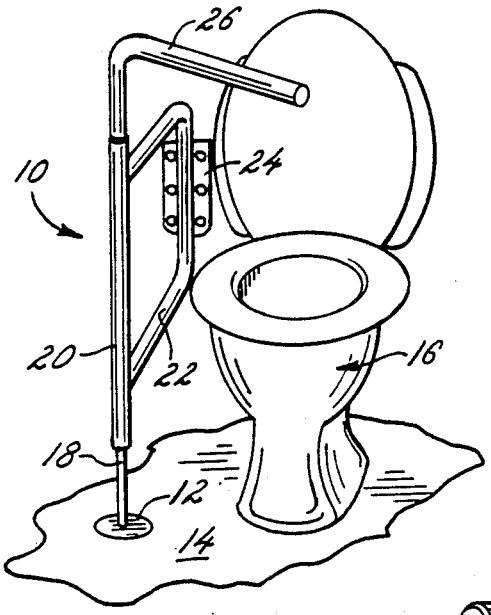
FIG. 2 (PRIOR ART)
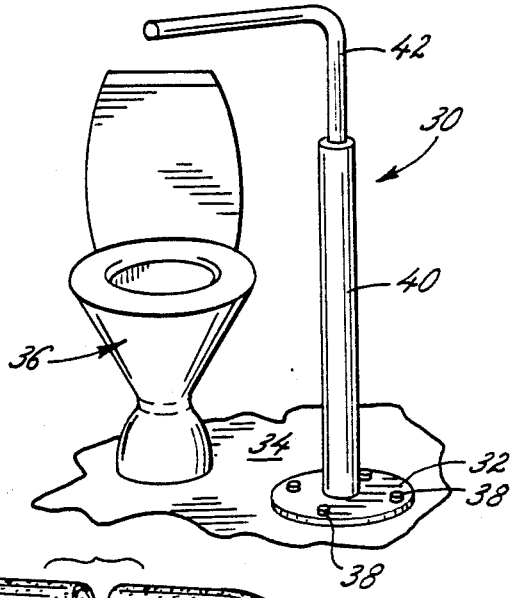
FIG. 3
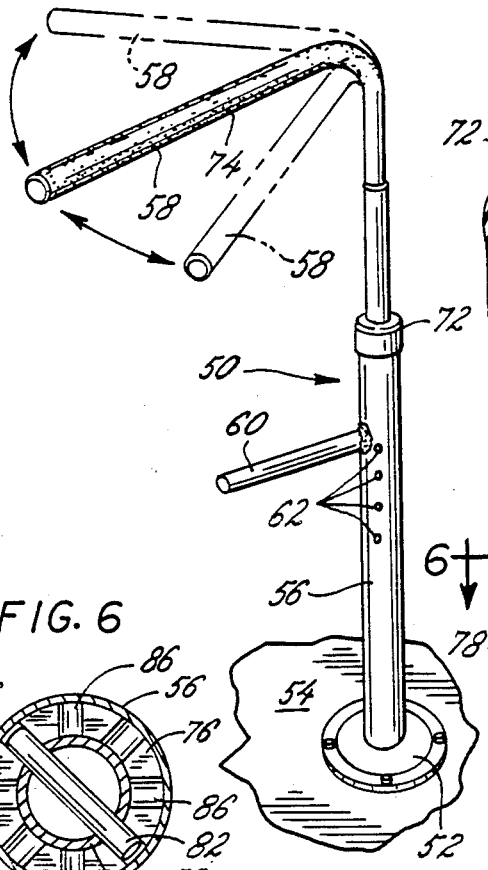
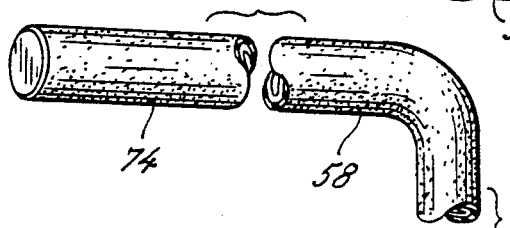
FIG. 4
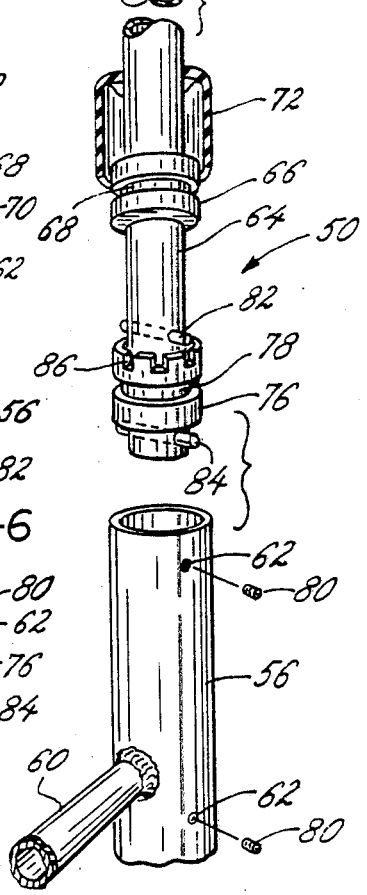
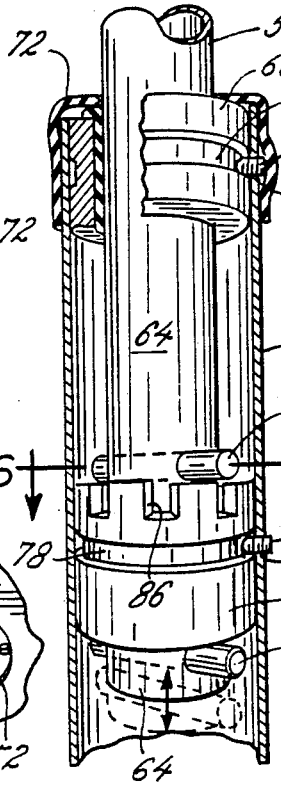
FIG. 5
FIG. 6
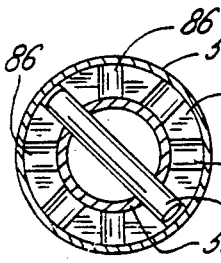

FIG. 7
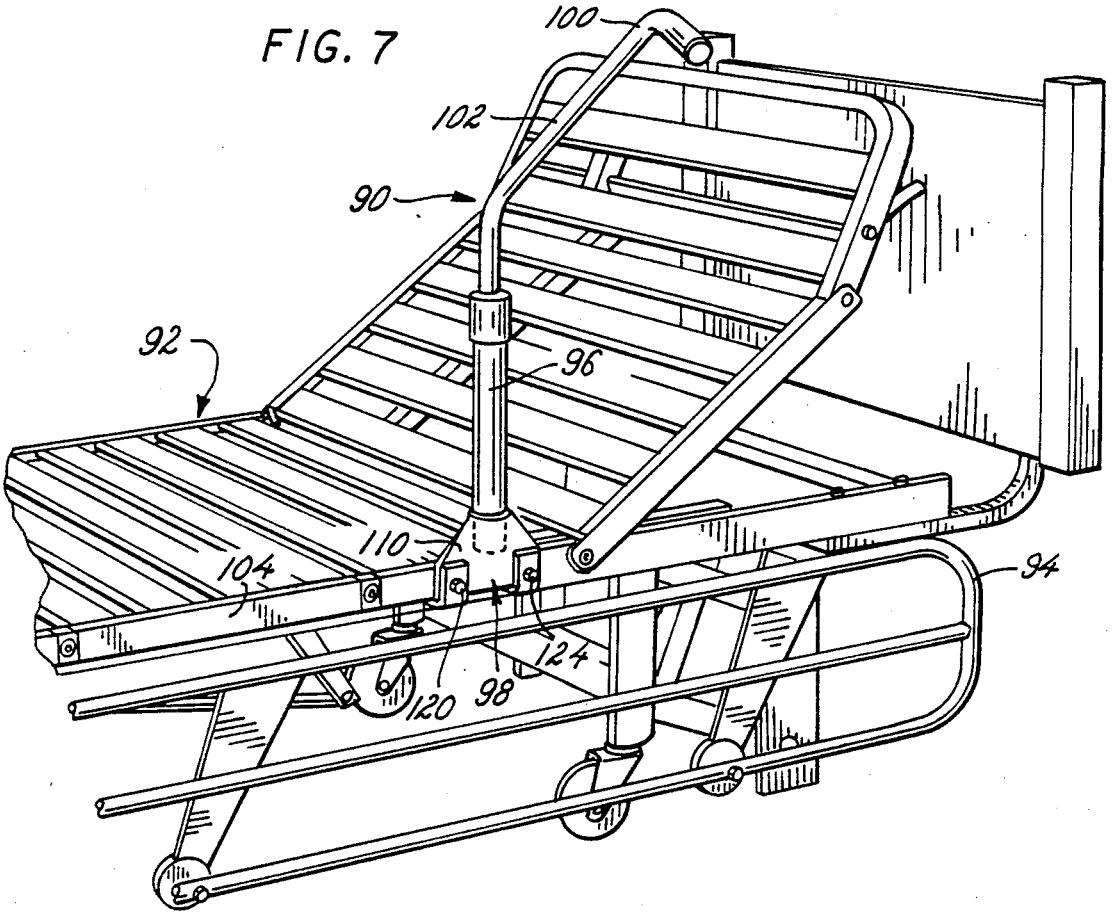
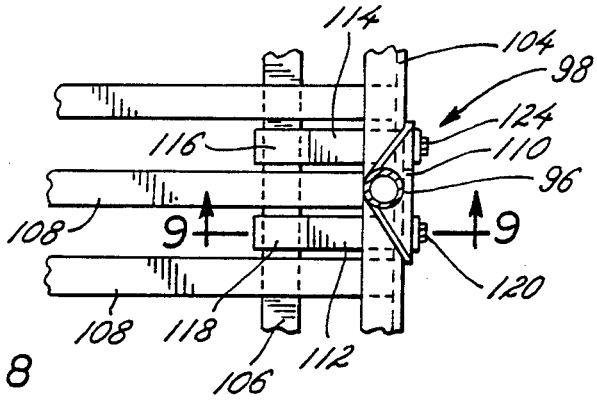
FIG. 8
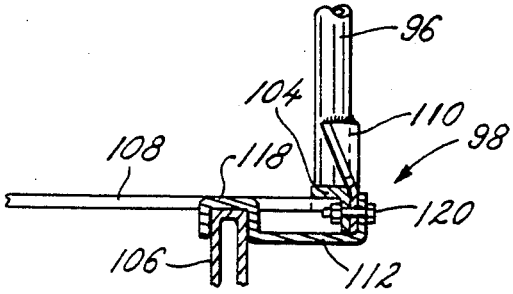
FIG. 9
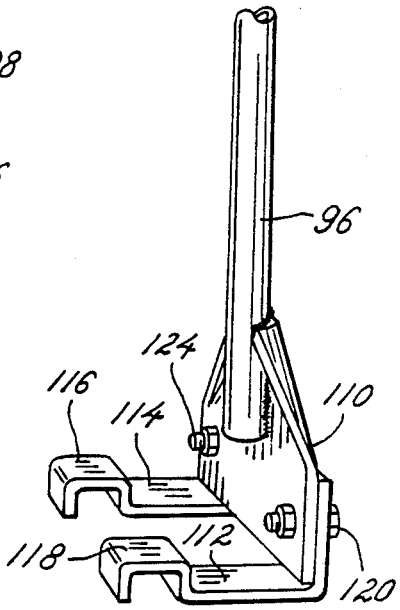
FIG. 10

MOVABLE SUPPORT BAR

BACKGROUND OF THE INVENTION

The invention relates generally to a movable support bar and more particularly to a movable support bar which can be mounted where desired, such as on a bed or adjacent a toilet, to provide support for a disabled or invalid person.

The independent use of a toilet or independently getting in or out of a bed can be virtually impossible for a disabled or invalid person without aid. The aid can be provided by another person, which generally is not desirable and can be expensive. This can be especially true when the disabled or invalid person is confined to a wheelchair. The disabled or invalid person often does not have sufficient strength to get into and out of the wheelchair unaided.

The prior art has utilized rods and railings in toilet facilities to aid in providing supports for the disabled or invalid person. One of the major problems of such railings is that they are not movable or adjustable, which still can make it very difficult, if not impossible, for the disabled or invalid person to get into and out of a wheelchair. A further problem is caused when the disabled or invalid person attempts to get into or out of a bed to a walker or wheelchair.

It therefore would be desirable to provide an adjustable and movable support for a disabled or invalid person so that the disabled or invalid person can get into and out of a wheelchair, to get into and out of a bed or to use a toilet.

SUMMARY OF THE INVENTION

The above and other disadvantages of prior art disabled or invalid person support structures and techniques are overcome in accordance with the present invention by providing an improved movable support bar, which can be mounted on a bed or adjacent a toilet to provide the desired independent support for the disabled or invalid person.

The movable support bar has an upstanding support tube which can be mounted on the floor or onto a bed. A movable arm is mounted in the support tube for angular movement therearound, locking in individual angular positions as desired. The movable arm is secured for rotation in the support tube, but cannot be removed therefrom. The movable arm can include a trigger mechanism to release the movable arm for movement to a new position.

When mounted on a bed, the support tube is offset onto the edge of the bed to allow the bed side railing to be operated without obstruction. Also, to facilitate the use of the movable support bar on the bed, the movable arm includes an offset angular arm position to provide room for and enable the disabled or invalid person to stand beside the bed before again moving the movable support bar.

BRIEF DESCRIPTION OF THE DRAWINGS

FIGS. 1 and 2 are perspective views of a prior art movable bar;

FIG. 3 is a perspective view of a first embodiment of the movable support bar of the present invention;

FIG. 4 is an exploded partial perspective view of the movable support bar embodiment of FIG. 3;

FIG. 5 is an enlarged partial sectional side view of the movable arm retaining mechanism of the movable support bar embodiment of FIG. 3;

FIG. 6 is a cross-sectional view taken along the line 6—6 of FIG. 5;

FIG. 7 is a perspective view of a second embodiment of the movable support bar of the present invention mounted onto a bed;

FIG. 8 is a top sectional view of the movable support bar embodiment of FIG. 7;

FIG. 9 is a cross-sectional view taken along the line 9—9 of FIG. 8; and FIG. 10 is a partial perspective view of the base support of the movable support bar embodiment of FIG. 7.

DESCRIPTION OF THE PREFERRED EMBODIMENTS

Referring to FIG. 1, a prior art support bar 10 is illustrated mounted on a base 12 to a floor 14 adjacent a toilet 16. The support bar 10 includes a rod 18 onto which is mounted a supporting tube or rod 20, having a U-shaped support tube 22 mounted thereto. The U-shaped support tube 22 includes a bracket 24, which is mounted to the toilet facility wall, such as by bolts or screws.

The upper end of the tube 20 includes a movable support bar 26, which is pivotable to a 0°, 45° or 90° position by lifting the bar 26 partially out of the tube 20 and turning the bar 26 to the next position. The bar 26 then provides the independent support for a disabled or invalid person in transferring between a wheelchair and the toilet and also for dressing. The support bar 10, however, has a potentially catastrophic defect, because the bar 26 is not retained in the tube 20 and can be removed therefrom when the bar 26 is lifted for rotating to a new position.

A second prior art support bar 30 is illustrated in FIG. 2, again mounted by a base 32 to a floor 34 adjacent a toilet 36. In this support bar 30, the base 32 is anchored to the floor 34, such as by bolts 38, to provide a self-supporting and freestanding support bar 30.

The support bar 30 again includes a support tube or rod 40, which again has a movable support bar 42 pivotally mounted therein. Again, as with the bar 26, the bar 42 is lifted for rotation, but can be inadvertently lifted clear out of the tube 40. Further, neither the support bar 10 or the support bar 30 are conveniently height adjustable to provide a different height for the bars 26 and 42. The support bar 10 can be adjusted somewhat prior to mounting of the bracket 24, but then cannot be adjusted further. The support bar 30 cannot be height adjusted at all.

Referring now to FIG. 3, a first embodiment of the movable support bar of the present invention is designated generally by the reference character 50. The movable support bar 50 includes a base support plate 52, which can be mounted to a floor 54 as desired, to support the movable support bar 50 in a freestanding position.

The movable support bar 50 includes a support tube or housing 56 into which is mounted a pivotable support bar or arm 58, which can be lifted and rotated to any desired position. The support tube 56 additionally includes a nonpivotable support arm or bar 60, which is mounted at an angle, preferably substantially perpendicular to the axis of the support tube 56. This provides a convenient second support structure at a different level for use by a disabled or invalid person, especially when sitting or rising from a seat such as onto or from a toilet.

The pivotable support bar 58 additionally is height adjustable, with the support tube 56 including a plurality of holes 62 or sets thereof spaced along the length of the support tube 56. The height adjustability as well as the retention of the pivotable support bar 58 in the support tube 56, is best illustrated with respect to FIGS. 4–6.

The pivotable support bar 58 includes a lower retaining arm 64, which extends into the support tube 56 through a bushing 66, such as a nylon bushing. The bushing 66 includes an outer channel or groove 68, which enables the bushing 66 to be mounted in the top end of the support tube in a fixed position by a setscrew 70 or other similar type securing device. The bushing 60 and the arm 64 extending therethrough, preferably are covered by a flexible polymeric dust cover cap or sleeve 72, to prevent dust or other foreign materials from entering the bearing surface. The pivotable support bar 58 also can include a friction type coating or sleeve 74 on its support portion to aid a disabled or invalid person in grasping the pivotable support bar 58.

The pivotable support bar 58 is lifted to pivot the pivotable support bar 58 to another position, but the pivotable support bar 58 cannot be lifted clear of the support bar 56 because it is retained in a second bushing 76 at the lower end of the arm 64. The bushing 76 again could include a groove or outer channel 78, which can be secured by one or more setscrews 80 or similar securing devices inserted through the holes 62. The screws 80 also could be threaded into mating threaded holes (not illustrated) in the bushing 76, to ensure that the bushing 76 does not rotate.

The arm 64 is retained in the bushing 76 by a pair of pins 82 and 84 mounted through the arm 64. The upper portion of the bushing 76 includes a plurality of radial slots 86 located at any desired angle, into which the pin 82 can be placed. The pivotable support bar 58 is lifted and rotated to the desired angle by the disabled or invalid person and then lowered to angularly fix the pivotable support bar position by the pin 82 residing in a pair of the slots 86.

The pivotable support bar 58 cannot be lifted from the support tube 56, since the lower pin 84 bears against the bearing 76 in the upper rotating position as illustrated in FIG. 5. Thus, the movable support bar 50 easily can be moved from angular position to angular position without fear of the pivotable support bar 58 being lifted from the support tube 56. Also, the height of the pivotable support bar 58 can easily be adjusted as desired, utilizing the holes 62 and the screws 80.

A second embodiment of the movable support bar of the invention is designated generally by the reference character 90, referring to FIGS. 7-10. The movable support bar 90 is designed to be mounted onto a bed 92, which is illustrated for example purposes only, and can include any metal frame type bed, especially for utilization with disabled or invalid persons. The bed 92 can include a side railing 94, which can be moved between the lower position as illustrated to an upper position adjacent the bed surface to prevent the disabled or invalid person from falling out of the bed 92.

The movable support bar 90 again includes a support tube 96, which can be mounted to the bed 92 by any convenient means, such as by a support bracket 98. The movable support bar 90 again preferably includes a pivotable support bar 100 mounted into the support tube 96, preferably in the same manner as the pivotable support bar 58. The pivotable support bar 100 includes an offset arm portion 102, which allows the disabled or invalid person to stand beside the bed 92, with the pivotable support bar 100 substantially parallel to the bed 92.

For the specific bed 92 illustrated, the support bracket 98 is mounted onto a bed frame 104 and a crossbar 106 onto which a plurality of mattress slats 108 are mounted. The support bracket 98 includes an upstanding flange portion 110 to which the support tube 96 is mounted, such as by welding, offset inwardly to allow the railing 94 to pass thereby. The flange 110 also includes a pair of support arms 112, 114 which are configured with an angled end 116, 118 to fit over the top of the crossbar 106. The support arms 112, 114 can be bolted or welded to the flange 110 and preferably include bolts 120, 122, which can be threadingly engaged into the frame 104 to ensure that the movable support bar 90 does not move.

Many modifications and variations of the present invention are possible in light of the above teachings. The movable support bars 50 and 90 have been illustrated as being freely liftable and pivotable, but can include a locking trigger or other release means which has to be activated before the movable support bars 50 and 90 can be moved between positions. It is, therefore, to be understood that within the scope of the appended claims, the invention may be practiced otherwise than as specifically described.

What is claimed and desired to be secured by Letters Patent of the United States is:

1. A movable support bar for aiding disabled or invalid persons, said movable support bar comprising:

a support tube, said support tube including a free upper end and a lower end mounted to a base for securing said support tube in an upstanding position;

a pivotable support bar having an upper pivotable support arm and a lower retaining arm secured at an angle to one another, said lower retaining arm mounted in said support tube free upper end for rotation from position to position therein by lifting said pivotable support bar, said pivotable support bar locked into a position when it is lowered; and including means for retaining said pivotable support bar in said support tube.

2. The movable support bar as defined in claim 1 including a fixed support arm secured to said support tube below said free upper end.

3. The movable support bar as defined in claim 1 including means for adjusting the height of said pivotable support bar relative to said base.

4. The movable support bar as defined in claim 1 wherein said retaining means include a bushing mounted in said support tube with said retaining arm extending therethrough, said retaining arm including a lower pin extending therethrough, to bear against said bushing when said pivotable support bar is lifted to prevent said pivotable support bar from being lifted from said support tube.

5. The movable support bar as defined in claim 4 wherein said bushing includes a slotted upper surface and said retaining arm includes a second upper pin which engages at least one of said slots when said pivotable support bar is lowered to fix said pivotable support bar in the position.

6. The movable support bar as defined in claim 4 including means for adjusting the height of said pivotable support bar relative to said base.

7. The movable support bar as defined in claim 6 wherein said height adjusting means include a plurality of holes or sets thereof along the length of said support tube and said bushing is movable and mountable in selected holes to adjust the height of said pivotable support bar.

8. The movable support bar as defined in claim 1 including said retaining arm extending freely through a bushing mounted in said free upper end of said support tube.

9. The movable support bar as defined in claim 8 including dust cover means for said bushing.

10. The movable support means as defined in claim 1 wherein said pivotable support arm is mounted to said lower retaining arm by an offset portion and said base includes means for mounting said support tube onto a bed.

11. The movable support means as defined in claim 10 wherein said mounting means include a flange for mounting said support tube inside of a frame of said bed, said bed frame including a crossbar and said flange including arms for securing said flange across said crossbar.

12. The movable support means as defined in claim 1 wherein said base includes means for mounting said base to a floor surface.

13. A movable support bar for aiding disabled or invalid persons, said movable support bar comprising:

a support tube, said support tube including a free upper end and a lower end mounted to a base for securing said support tube in an upstanding position, said base including means for mounting said support tube onto a bed;

a pivotable support bar having an upper pivotable support arm and a lower retaining arm secured at an angle to one another and including an offset portion therebetween, said lower retaining arm mounted in said support tube free upper end for rotation from position to position therein by lifting said pivotable support bar, said pivotable support bar locked into a position when it is lowered; and including means for retaining said pivotable support bar in said support tube.

14. The movable support means as defined in claim 13 wherein said mounting means include a flange for mounting said support tube inside of a frame of said bed, said bed frame including a crossbar and said flange including arms for securing said flange across said crossbar.

15. The movable support bar as defined in claim 13 wherein said retaining means include a bushing mounted in said support tube with said retaining arm extending therethrough, said retaining arm including a lower pin extending therethrough, to bear against said bushing when said pivotable support bar is lifted to prevent said pivotable support bar from being lifted from said support tube.

16. The movable support bar as defined in claim 15 wherein said bushing includes a slotted upper surface and said retaining arm includes a second upper pin which engages at least one of said slots when said pivotable support bar is lowered to fix said pivotable support bar in the position.

17. The movable support bar as defined in claim 15 including means for adjusting the height of said pivotable support bar relative to said base.

18. The movable support bar as defined in claim 17 wherein said height adjusting means include a plurality of holes or sets thereof along the length of said support tube and said bushing is movable and mountable in selected holes to adjust the height of said pivotable support bar.

19. The movable support bar as defined in claim 13 including said retaining arm extending freely through a bushing mounted in said free upper end of said support tube.

20. A movable support bar for aiding disabled or invalid persons, said movable support bar comprising:

a support tube, said support tube including a free upper end and a lower end mounted to a base for securing said support tube in an upstanding position, said base including means for mounting said base to a floor surface;

a pivotable support bar having an upper pivotable support arm and a lower retaining arm secured at an angle to one another, said lower retaining arm mounted in said support tube free upper end for rotation from position to position therein by lifting said pivotable support bar, said pivotable support bar locked into a position when it is lowered; and including means for retaining said pivotable support bar in said support tube.

21. The movable support bar as defined in claim 20 including a fixed support arm secured to said support tube below said free upper end.

22. The movable support bar as defined in claim 20 wherein said retaining means include a bushing mounted in said support tube with said retaining arm extending therethrough, said retaining arm including a lower pin extending therethrough, to bear against said bushing when said pivotable support bar is lifted to prevent said pivotable support bar from being lifted from said support tube.

23. The movable support bar as defined in claim 22 wherein said bushing includes a slotted upper surface and said retaining arm includes a second upper pin which engages at least one of said slots when said pivotable support bar is lowered to fix said pivotable support bar in the position.

24. The movable support bar as defined in claim 22 including means for adjusting the height of said pivotable support bar relative to said base.

25. The movable support bar as defined in claim 24 wherein said height adjusting means include a plurality of holes or sets thereof along the length of said support tube and said bushing is movable and mountable in selected holes to adjust the height of said pivotable support bar.

26. The movable support bar as defined in claim 20 including said retaining arm extending freely through a bushing mounted in said free upper end of said support tube.

* * * * *